United States Patent [19]

Morimoto et al.

[11] Patent Number: 4,595,862

[45] Date of Patent: Jun. 17, 1986

[54] GRAPHIC FLUORESCENT DISPLAY DEVICE

[75] Inventors: Kiyoshi Morimoto; Hiroshi Watanabe; Yoshihisa Tsuruoka; Yukihiko Shimizu, all of Mobara, Japan

[73] Assignee: Futaba Denshi Kogyo K.K., Mobara, Japan

[21] Appl. No.: 655,456

[22] Filed: Sep. 28, 1984

[30] Foreign Application Priority Data

Sep. 30, 1983 [JP] Japan ..... 58-152804[U]

[51] Int. Cl.[4] ..... G09G 3/10

[52] U.S. Cl. ..... 315/169.4; 315/169.1

[58] Field of Search ..... 315/169.4, 169.3, 169.1

[56] References Cited

U.S. PATENT DOCUMENTS 4,218,636 8/1980 Miyazawa ..... 315/169.1

4,459,514 7/1984 Morimoto et al. ..... 315/169.1

*Primary Examiner*—Harold Dixon

*Attorney, Agent, or Firm*—Oblon, Fisher, Spivak, McCelland & Maier

[57] ABSTRACT

A graphic fluorescent display device is disclosed which is capable of effectively eliminating a streak pattern occurring right below cathodes. The fluorescent display device is constructed in such a manner that an electric field controlling electrode is disposed on the surface of a cover plate opposite to a substrate having anodes formed thereon, and potential positive with respect to the cathodes is applied to the electric field controlling electrode so that electrons emitted from the cathodes may be diffused by the positive electric field of the electric field controlling electrode.

4 Claims, 8 Drawing Figures

GRAPHIC FLUORESCENT DISPLAY DEVICE

BACKGROUND OF THE INVENTION

1. Field of the Invention

This invention relates to a fluorescent display device, and more particularly to a graphic fluorescent display device which is capable of improving the quality of the display.

2. Description of the Prior Art

With the diversification of display, a fluorescent display device for effecting graphic display has been extensively put in practice in the art which is adapted to carry out image display such as desired letters, figures and the like in addition to a fluorescent display device of the type of selectively exciting figure eight shaped segment anodes to carry out numerical display.

In general, a fluorescent display device is advantageous in that it can be driven at low voltage with less power consumption, formed in a flat shape and provide luminous display which is readily observed. Thus, it is expected to be much in demand as a display device for terminal components in various types of information system in place of a cathode ray tube.

Although a graphic display system using a fluorescent display device may employ various electrode structures, an X-Y matrix drive structure is generally employed in view of easiness in manufacture, the number of external lead wires, facility in operation, and the like which is constructed in a manner to arrange control electrodes in the direction across that of arrangement of anodes, and adapted to scan the control electrodes in a time-sharing manner and supply a display signal to a desired row of the anodes in synchronism with the scanning of the control electrodes.

A typical electrode structure of such type is shown in FIG. 1. In the electrode structure shown in FIG. 1, phosphor-coated anodes A are connected together by a wiring conductor every row and control electrodes G are arranged in the column direction of the anodes A. The control electrode G are scanned in a time-sharing manner and a display signal is supplied to the anodes A via the wiring conductor C. Further, electrons emitted from a cathode (not shown) impinge on the anode positioned at the intersection between a selected row of the anodes A and the control electrodes to excite the phosphor deposited on the anode A to carry out the light-emission.

However, in the fluorescent display device shown in FIG. 1, it is substantially difficult to arrange the anodes in the column direction at narrow intervals, because it is required to arrange the control electrodes of a mesh-like shape opposite to each column of the anodes, which results in the arrangement of the anodes with a high density being substantially impossible. Further, the construction of the fluorescent display device shown in FIG. 1 causes the unselected control electrodes to be kept at negative potential with respect to the cathode, and the path of electrons to the anodes A is affected by a negative electric field generated by the unselected control electrode of negative potential adjacent to the selected control electrode. This results in the electrons failing to uniformly impinging on the overall surface of the anode A, to thereby cause a display defect.

In order to eliminate the above-described disadvantages of the fluorescent display device shown in FIG. 1, the inventors previously proposed a graphic fluorescent display device as shown in FIG. 2, which is now U.S. Pat. No. 4,459,514, issued July 10, 1984.

The fluorescent display device shown in FIG. 2 is constructed in such a manner that anodes conductors are arranged in parallel in a stripe shape in the row direction within a display region, a phosphor is deposited on each of the anode conductors to form an anode SA, and control electrodes G (G1, G2 - - - ) are arranged in the column direction with respect to the anodes SA.

In the operation of the fluorescent display device shown in FIG. 2, adjacent two of the control electrodes are selectively scanned together while shifting selection of the control electrodes one by one in order or two of the control electrodes are scanned together in order of G1 and G2, G2 and G3, G3 and G4 - - - , and a display signal is supplied to the anodes SA in synchronism with the scanning of the control electrodes so that luminous display may be carried out by a picture cell constituted by a region on the anode interposed between the two control electrodes, for example, a region P shown in FIG. 2.

The fluorescent display device shown in FIG. 2 can be easily manufactured because of its simplified control electrode structure. Also, it does not cause a display defect since one picture cell is formed by a region controlled by the adjacent two control electrodes G.

A fluorescent display device of the type shown in FIG. 2 is required to carry out display of a high quality as well as display of a high density and any display in the form of letters, figures and the like. For this purpose, it is indispensable to substantially prevent the occurrence of dark areas called dark lines or high luminance areas called bright lines between plural cathodes stretchedly arranged. This is accomplished, for example, by narrowing the interval between each adjacent cathodes in relation to the distance between the cathodes and the control electrodes or by providing an electrode means for diffusing electrons emitted from the cathodes on the surface of a casing of the display device opposite to the anodes with the control electrodes and cathodes being interposed between the surface and the anodes. These are effective to eliminate the dark lines or bright lines between the cathodes.

It has been found, however, that the fluorescent display device shown in FIG. 2 has a factor adversely affecting the quality of display other than the problem of dark lines or bright lines as described above. More particularly, when the cathodes K are stretchedly arranged in the direction parallel to the anodes SA, a streak pattern D of non-uniform brightness occurs right below the cathodes K which appears to correspond to the shade of the control electrode G.

The formation of such streak pattern D would be due to that the adjacent two control electrodes G selected and scanned form a sort of electrostatic lens, which deflects electrons emitted from the cathodes K right below the cathodes K to cause the non-uniform stream of electrons at the areas right below the control electrodes G and at the peripheries thereof. Particularly, the streak pattern D is an obstacle to display when increasing a light-emission area of a display region or when carrying out inversion display or display carried out by emitting light from picture cells forming the background and using non-luminous picture cells.

Accordingly, the problem of the streak pattern is not solved by arranging the cathodes at a narrow interval between each adjacent cathodes or the like. Thus, it is highly desired to develop a fluorescent display device which is capable of eliminating the problem.

SUMMARY OF THE INVENTION

The present invention has been made in view of the foregoing disadvantage of the prior art and as a result of various experiments to eliminate the so-called streak pattern occurring right below cathodes which corresponds to the shade of control electrodes, taking notice of the fact that the region of occurrence of the streak pattern is substantially narrowed by forming an electric field controlling electrode on the inner surface of a casing of a fluorescent display device opposite to anodes with the cathodes and control electrodes being interposed between the controlling electrode and the anodes and applying to the control electrodes suitable potential positive with respect to the cathodes.

Accordingly, it is an object of the present invention to provide a graphic fluorescent display device which is capable of effectively eliminating the so-called streak pattern occurring right below cathodes.

In accordance with the present invention, there is provided a graphic fluorescent display device comprising a substrate formed of an insulating material, a plurality of phosphor-coated anodes arranged in parallel with one another on the substrate, a plurality of linear control electrodes arranged in a manner to be spaced from the anodes and in the direction across the anodes, a cathode means stretched above the control electrodes, the region on each of the anodes controlled by adjacent at least two of the conrol electrodes forming one picture cell, and an electric field controlling electrode arranged opposite to the anodes with the control electrodes and cathode means being interposed between the anodes and the electric field controlling electrode, to which potential positive with respect to the cathode means is applied.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein.

DETAILED DESCRIPTION OF THE PREFERRED EMBODIMENTS

Now, a graphic fluorescent display device according to the present invention will be described with reference to FIGS. 4 to 8.

Figure 4:
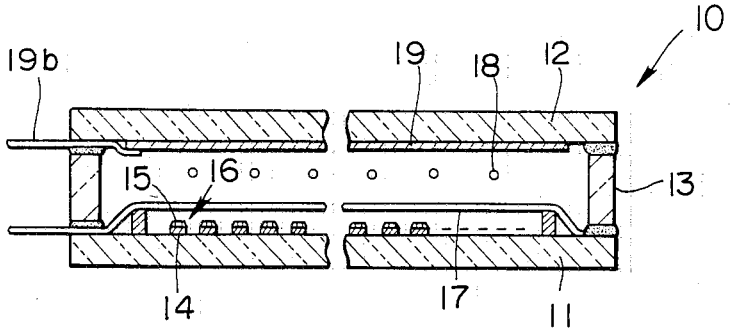
FIG. 4 is a schematic sectional view showing a first embodiment of a graphic fluorescent display device according to the present invention.

FIG. 4 illustrates one embodiment of a graphic fluorescent display device according to the present invention. The fluorescent display device shown in FIG. 4 includes a casing 10 hermetically sealed to hold electrodes received therein at a high vacuum, which comprises a substrate 11 having an anode section formed thereon, a cover plate 12 opposite to the substrate and side walls 13. The casing 10 is evacuated through an exhaust tube (not shown) to a high vacuum. Reference numeral 14 designates anode conductors arranged in a stripe shape on one surface of the substrate 11. The anode conductors 14 each have a fluorescent layer 15 deposited thereon to form an anode 16.

When the fluorescent display device is observed through the substrate 11, the anode conductor 14 and substrate 11 each are required to be light-permeable. More particularly, the substrate 11 may be formed of glass material, and the anode conductor 14 may be formed of a transparent conductive film of $SnO_2$, ITO (indium-tin-oxide) or the like or a metallic film having interstices formed in a mesh-like or stipe shape.

The fluorescent display device of the illustrated embodiment also includes a plurality of linear control electrodes 17 arranged in the direction across the anodes 16. The control electrodes 17 each have one end air-tightly passing through the casing 10 to be led out to the exterior, to thereby form a terminal. Above the control electrodes 17 are stretchedly arranged a plurality of filamentary cathodes 18, which are supported by a supporting means (not shown) provided on the side of the substrate 11 or cover plate 12.

Figure 1:
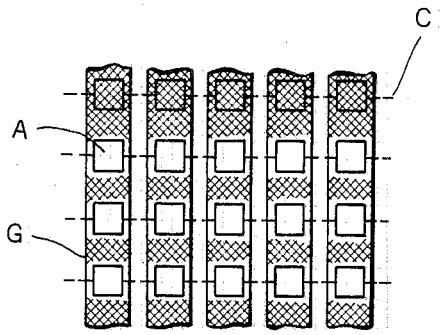
FIG. 1 is a schematic view showing one example of the electrode structure of a conventional graphic fluorescent display device.
Figure 2:
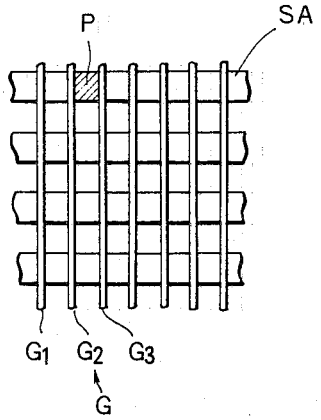
FIG. 2 is a schematic view showing the electrode structure of a graphic fluorescent display device of the same type as the present invention.
Figure 3:
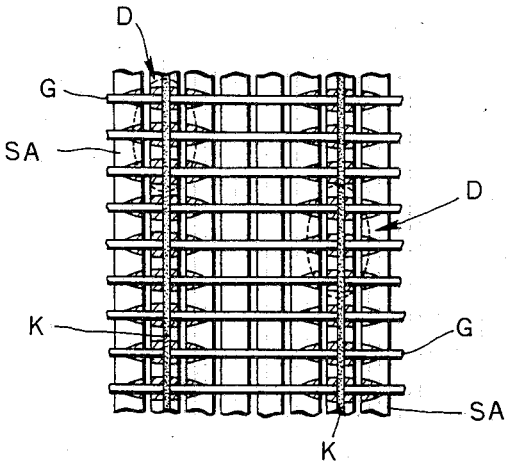
FIG. 3 is a schematic view showing the problem of the fluorescent display device of FIG. 2.

As can be seen from the foregoing, the arrangement of the electrodes in the fluorescent display device shown in FIG. 4 is the substantially same as that in the device of FIG. 3 described above.

Figure 5:
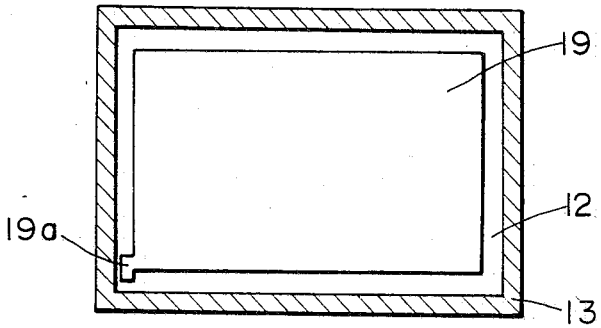
FIG. 5 is a plan view showing the essential part of the fluorescent display device of FIG. 4.

The illustrated embodiment also includes an electric field controlling electrode 19 forming one of the features of the present invention. The electric field controlling electrode 19, as shown in FIG. 5, is formed on the surface of the cover plate 12 opposite to the anodes 16 so as to substantially cover the overall display region, and is adapted to be applied thereto positive potential of a given range or level from an external source (not shown) through a terminal **19*b* connected to the connection end 19*a* thereof. When the fluorescent display device is observed through the cover plate 12, the electric field controlling electrode 19 is required to be formed of a light-permeable material. When it is the type of observing display from the substrate side, the use of such material is not required for the formation of the electrode 19. For example, the formation of the electric field controlling electrode 19 using graphite is effective to keep the fluorescent display device at a high vacuum, because graphite functions as a getter or has an action of absorbing residual gas in the device. Also, the electrode 19 of graphite effectively acts to shield light which is to get into the device from the exterior through the cover plate 12. Further, the use of graphite for the electric field controlling electrode 19 has another advantage of effectively preventing the deterioration of the contrast of display caused due to that light emitted from a luminous picture cell is reflected by the surface of the cover plate 12** to irradiate a non-luminous picture cell.

The anode conductors 14 and cathodes 18 are electrically connected with terminals (not shown) air-tightly passing through the casing 10 to permit electric signals to be supplied thereto from the exterior, respectively, as in the conventional fluorescent display device.

Now, the manner of operation of the fluorescent display device constructed as described above will be described hereinafter.

Adjacent two of the control electrodes 17 are selectively scanned together in a time-sharing manner while shifting selection of the control electrodes one by one in order. Alternatively, each adjacent three of the control electrodes may be scanned together so as to enlarge the display area of each picture cell. In synchronism with the scanning of the control electrodes 17, a display signal is supplied to the anodes 16, and electrons emitted from the cathodes 18 impinge on the region of the anode 16 controlled by the two control electrodes 17 subjected to the selective scanning to energize the phosphor layer 15 of the anode, so that the phosphor layer may carry out light-emission.

At this time, the electric field controlling electrode 19 is concurrently applied thereto through the terminal 19*b* potential of a given range or level which is positive with respect to the cathodes 18.

The positive electric field of the electric field controlling electrode 19 thus formed effectively controls the electric field right below the cathodes 18 in cooperation with the positive and negative electric fields of the control electrodes 17. This results in electrons emitted from the cathodes 18 being diffused in the direction of arrangement of the cathodes so that an effect may be exhibited which is the substantially same as that obtained due to the enlargement of electronemission surface of each cathode.

Figure 6:
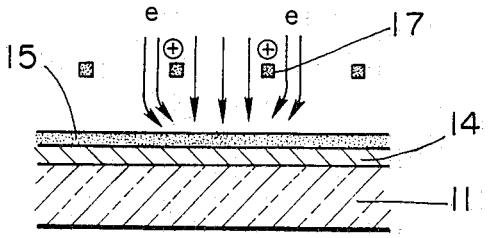
FIG. 6 is a schematic sectional view showing the operation of the fluorescent display device of FIG. 4.

Thus, the two control electrodes 17 subjected to the selective scanning to be applied thereto positive potential allows the controlled range of electrons e to be relatively enlarged so that electrons may impinge on the anode 16 from the various directions as shown in FIG. 6. Thus, it will be noted that the embodiment illustrated substantially eliminates the above-mentioned streak pattern right below the cathodes 18 or significantly reduces the region of occurrence of the streak pattern.

The value of positive voltage applied to the electric field controlling electrode 19 is varied depending upon voltage applied to the control electrodes 17, voltage applied to the cathodes 18 and the like. Such voltage applied to the electric field controlling electrode 19 has a relationship as generally shown in FIG. 7 with respect to the inflow current thereof.

More specifically, in the region A at which the voltage Es applied to the electrode 19 is below a value E1, the streak pattern is formed right below the cathodes 18, while it is substantially eliminated in the region where the voltage Es is between the value E1 and a value E2.

Figure 7:
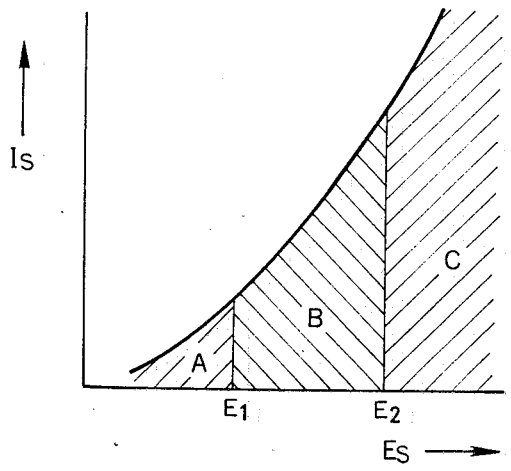
FIG. 7 is a graphical representation showing the relationship between inflow current and voltage of an electric field controlling electrode in the fluorescent display device of FIG. 4.

The inflow current Is of the electric field controlling electrode 19 increases with the increase in the voltage Es, as shown in FIG. 7. This clearly indicates that the ratio of electrons directed to the anodes 16 to electrons emitted from the cathodes is decreased to increase invalid current which does not contribute to the display. Accordingly, the voltage Es is desirably set near the value E1. Also, when the voltage Es exceeds the value E2, electrons directed to the anodes 16 are substantially decreased. This results in electric current flowing into the region of the anode below the space between each adjacent cathodes being substantially decreased as compared with that flowing into the region thereof right below the cathode, and the region right below the cathode is observed as a bright one.

Thus, it will be noted that the region C of the voltage Es above the value E2 does not allow display of a good quality to be obtained. Accordingly, the voltage Es should be set between the values E1 and E2.

One example is that, supposing that pulse voltage having a crest value of 90 V is applied to the selected anodes 16 and control electrodes 17, voltage of 4.5 V is applied to the cathodes 18 and cut-off bias voltage of −6 V is applied to the unselected anodes 16 and control electrodes 17, the optimum voltage Es is between 15 V and 60 V.

Thus, it will be noted that the application of positive potential of a given range or level to the electric field controlling electrode 19 in view of voltage of the anodes and control electrodes and the like substantially eliminates the streak pattern right below the cathodes 18 or significantly narrows the area of occurrence of the streak pattern.

In the embodiment described above, the cathodes 18 are stretched in the direction of arrangement of the anodes 16. However, the streak pattern occurs also when the cathodes 18 are stretched in the direction of arrangement of the control electrodes 17. Also in this case, the elimination of streak pattern is effectively accomplished by arranging the electric field controlling electrode in the same manner and applying positive potential of a given range or level to the electrode.

In such a fluorescent display device, a system that the cathodes 18 are driven by a D.C. power supply is often employed. In this instance, a potential gradient occurs between the terminal of each cathode having positive potential and the terminal thereof having negative potential due to the cathodes having their own resistance. Accordingly, in a fluorescent display device adapted to heat such cathodes by means of a D.C. power supply, the uniform elimination of the streak pattern over the whole display region is effectively carried out by causing each of the electric field controlling electrodes to have a potential gradient corresponding to the potential gradient of each of the cathodes to render the potential difference between the control electrodes and the cathodes substantially uniform over the entire display region.

Figure 8:
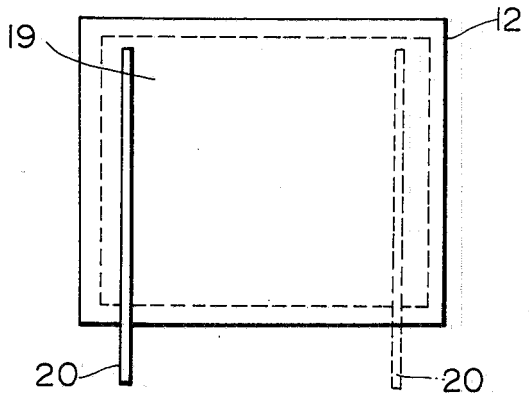
FIG. 8 is a plan view showing the essential part of a second embodiment of a fluorescent display device according to the present invention.

FIG. 8 shows another embodiment of a graphic fluorescent display device according to the present invention which is constructed for this purpose. More particularly, in the embodiment illustrated, a cover plate 12 on which an electric field controlling electrode 19 is to be formed has a wiring 20 of Ag or the like formed on one side end thereof in the direction of arrangement of cathodes, and on which the electric field controlling electrode 19 is formed of, for example, graphite or a transparent conductive film having a suitable resistivity, or the like. In the fluorescent display device of such contruction, when positive potential is applied to the wiring 20 of the electric field controlling electrode 19, an electric current flows through the electric field controlling electrode to allow a fall of potential to occur due to the resistance of the graphite to form a potential gradient therethough. The potential gradient is aligned with that of the cathodes by directionally aligning it with the potential gradient of the cathodes and suitably adjusting the resistivity of the material forming the electric field controlling electrode 19.

Alternatively, the embodiment may be modified in a manner such that a further wiring 20 shown in dotted lines in FIG. 8 is provided on the other end of the cover plate 12, and the electric field controlling electrode is formed of graphite or the like on the wirings 20. In the modification, when a D.C. power supply is connected between the wirings in the direction of applying voltage to the cathodes, a potential gradient is formed on the electrode 19 due to the resistance of the electric field controlling electrode which is sufficient to render the potential difference between the cathodes and the electric field controlling electrode substantially uniform.

As can be seen from the foregoing, the fluorescent display device for image display according to the present invention is constructed in the manner that the anodes are arranged in the direction across the control electrodes, and the electric field controlling electrode is disposed on the surface of the cover plate opposite to the substrate having the anodes formed thereon. Thus, potential of a given range or level positive with respect to the cathodes is constantly applied to the electric field controlling electrode.

Accordingly, in the present invention, electrons emitted from the cathodes are diffused by the positive electric field of the electric field controlling electrode. This results in the control electrodes carrying out the acceleration and controlling of electrons over a wide range, so that the streak pattern right below the cathodes which is the new problem inherent in such a graphic fluorescent display device may be effectively eliminated.

Thus, it will be noted that the present invention significantly improve the quality of display over the whole display region and performs image display of a high quality, particularly, in the inversion display operation.

Obviously many modifications and variations of the present invention are possible in the light of the above teachings. It is therefore to be understood that within the scope of the appended claims the invention may be practiced otherwise than as specifically described.

We claim:

1. A graphic fluorescent display device comprising:

a substrate formed of an insulating material;

a plurality of phosphor-coated anodes arranged in parallel with one another on said substrate;

a plurality of linear control electrodes arranged in a manner to be spaced from said anodes and in the direction across said anodes;

a cathode means stretched above said control electrodes;

the region on each of said anodes controlled by adjacent at least two of said control electrodes forming one picture cell; and an electric field controlling electrode arranged opposite to said anodes with said control electrodes and cathode means being interposed between said anodes and said electric field controlling electrode, to which potential positive with respect to said cathode means is applied.

2. A graphic fluorescent display device as defined in claim 1, wherein said electric field controlling electrode is formed of graphite.

3. A graphic fluorescent display device as defined in claim 1, wherein said cathode means is drvien by a D.C. power supply, and said electric field controlling electrode is applied thereto potential to allow a potential gradient to be formed on said electric field controlling electrode in the direction in alignment with the potential gradient of said cathode means.

4. A graphic fluorescent display device as defined in claim 3, wherein said electric field controlling electrode is formed of a resistance material.

* * * * *